US009180669B2

(12) United States Patent
Kinoshita et al.

(10) Patent No.: US 9,180,669 B2
(45) Date of Patent: Nov. 10, 2015

(54) LIQUID EJECTING HEAD AND LIQUID EJECTING APPARATUS

(71) Applicant: SEIKO EPSON CORPORATION, Tokyo (JP)

(72) Inventors: Ryota Kinoshita, Matsumoto (JP); Shunsuke Watanabe, Matsumoto (JP); Keigo Yamasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/447,486

(22) Filed: Jul. 30, 2014

(65) Prior Publication Data

US 2015/0035910 A1 Feb. 5, 2015

(30) Foreign Application Priority Data

Aug. 1, 2013 (JP) ..... 2013-160167

(51) Int. Cl.
*B41J 2/045* (2006.01)
*B41J 2/14* (2006.01)
*B41J 2/19* (2006.01)

(52) U.S. Cl.
CPC ..... *B41J 2/14233* (2013.01); *B41J 2/14201* (2013.01); *B41J 2/19* (2013.01); *B41J 2202/11* (2013.01)

(58) Field of Classification Search
CPC ..... B41J 2002/14306; B41J 2202/07; B41J 2/19; B41J 2/14201; B41J 2/14233; B41J 2/14032
See application file for complete search history.

(56) References Cited

U.S. PATENT DOCUMENTS 5,455,615 A * 10/1995 Burr et al. ..... 347/92

FOREIGN PATENT DOCUMENTS

JP 02-52745 2/1990

* cited by examiner

*Primary Examiner* — Geoffrey Mruk
(74) *Attorney, Agent, or Firm* — Workman Nydegger

(57) ABSTRACT

A common liquid chamber that communicates with a plurality of pressure chambers includes at least one inflow port into which a liquid flows, a plurality of supply openings, arranged in a row, for supplying the liquid to each of the pressure chambers, and a slanted surface that, when viewed from a second direction that is orthogonal to an arrangement direction in which the supply openings are arranged and that follows a substrate in which the common liquid chamber is formed, is slanted so that the slanted surface overlaps with the arrangement of some of the supply openings including supply openings located at ends of the arrangement direction and approaches the arrangement of the supply openings at the end areas of the arrangement direction. At least part of the inflow port is located within the range of the arrangement of the stated some of the supply openings when viewed from the second direction. An angle of the slanted surface and a position of the inflow port are set so that a flow rate of the liquid is no less than 0.025 m/s in the vicinity of an end of the inflow port in the arrangement direction when the liquid is sucked from the nozzle openings by applying negative pressure to the nozzle openings.

12 Claims, 11 Drawing Sheets

LIQUID EJECTING HEAD AND LIQUID EJECTING APPARATUS

BACKGROUND

1. Technical Field

The present invention relates to liquid ejecting heads and liquid ejecting apparatuses.

2. Related Art

A known example of a liquid ejecting head is an ink jet head that ejects ink droplets from a nozzle opening by applying pressure to ink within a pressure chamber that communicates with the nozzle opening. When bubbles enter into a reservoir (common liquid chamber) that communicates with a plurality of pressure chambers, during printing those bubbles may enter into individual flow channels leading to the nozzle openings. This can result in missing dots, where ink droplets are not ejected from the nozzle opening, which reduces print quality. Accordingly, a cleaning process is carried out to discharge bubbles from within the reservoir. In this cleaning process, an interior space formed by the ink jet head and a cap is depressurized in order to forcefully suck ink from the nozzle openings.

In an ink jet head disclosed in JP-A-2-52745, protrusions are provided in the vicinity of an entrance into which the ink flows from an ink tank into the reservoir so that the flow of ink within the reservoir does not stagnate and bubbles within the reservoir can be smoothly discharged to the exterior of the head.

Configurations that reduce the size of the reservoir are in demand for the purpose of miniaturizing the ink jet head. However, when the size of the reservoir is reduced, the flow channels are also narrowed as a result, making it easier for bubbles to accumulate within the reservoir. Accordingly, bubbles within the reservoir may not be discharged even if a cleaning process is carried out. Note that this problem is not limited to ink jet heads, and occurs in various types of liquid ejecting heads and liquid ejecting apparatuses as well.

SUMMARY

It is an advantage of some aspects of the invention to provide a technique that enables an improvement in the ability to discharge bubbles.

A liquid ejecting head according to an aspect of the invention includes a pressure chamber that communicates with a nozzle opening and a common liquid chamber that communicates with a plurality of the pressure chambers. The common liquid chamber has at least one inflow port into which a liquid flows; a plurality of supply openings, arranged in a row, for supplying the liquid to each of the pressure chambers; and a slanted surface that, when viewed from a second direction that is orthogonal to an arrangement direction in which the plurality of supply openings are arranged and that follows a substrate in which the common liquid chamber is formed, is slanted so that the slanted surface overlaps with the arrangement of some of the supply openings including supply openings located at ends of the arrangement direction and approaches the arrangement of the supply openings at the end areas of the arrangement direction. At least some of the inflow ports are within a range of the arrangement of the stated some of the supply openings when viewed from the second direction, and a slope of the slanted surface and a position of the inflow port are set so that a flow rate of the liquid is no less than 0.025 m/s (meters per second) in the vicinity of an end of the inflow port in the arrangement direction when the liquid is sucked from the nozzle openings by applying negative pressure to the nozzle openings.

A liquid ejecting apparatus according to another aspect of the invention is a liquid ejecting apparatus such as an ink jet printer that includes the aforementioned liquid ejecting head.

Bubbles within the common liquid chamber can be favorably discharged when the slope of the slanted surface and the position of the inflow port are set so that the flow rate of the liquid is no less than 0.025 m/s in the vicinity of the end of the inflow port in the arrangement direction when the liquid is sucked from the nozzle openings by applying negative pressure to the nozzle openings. On the other hand, the discharge properties for bubbles within the common liquid chamber are not favorable when the slope of the slanted surface and the position of the inflow port are set so that the flow rate is less than 0.025 m/s.

Accordingly, these aspects can provide a liquid ejecting head and a liquid ejecting apparatus capable of improving the bubble discharge properties.

Here, a single inflow port having a long-hole shape may be provided in the common liquid chamber, or a plurality of inflow ports may be provided in the common liquid chamber.

The slanted surface may be a flat surface or may be curved.

According to another aspect of the invention, it is preferable that slope of the slanted surface and the position of the inflow port be set so that the flow rate of the liquid is no less than 0.03 m/s in the vicinity of the end of the inflow port in the arrangement direction when the liquid is sucked from the nozzle openings by applying negative pressure to the nozzle openings. According to this aspect, a technique that enables the bubble discharge properties to be improved further can be provided.

According to another aspect of the invention, it is preferable that there be 30 supply openings from an end of the plurality of supply openings in the arrangement direction to an end of the inflow port in the arrangement direction. According to this aspect, a technique that enables the bubble discharge properties to be improved further can be provided.

According to another aspect of the invention, it is preferable that the slope of the slanted surface and the position of the inflow port be set so that during recording by ejecting the liquid from the nozzle openings, there is a difference of no more than 300 Pa between a pressure loss from the inflow port up to the nozzle opening that communicates with the supply opening at the end of the plurality of supply openings in the arrangement direction and a pressure loss from the inflow port up to the nozzle opening that communicates with a supply opening in a center of the plurality of supply openings in the arrangement direction. According to this aspect, there is little difference between the liquid ejection from the nozzles that communicate with supply openings at the ends and the liquid ejection from the nozzles that communicate with supply openings at the center, and thus a technique that improves the quality of recorded material can be provided.

According to another aspect of the invention, it is preferable that an edge portion at the end of the inflow port in the arrangement direction have a beveled shape. According to this aspect, it is difficult for bubbles to hang up on the edge portion of the inflow port, and thus a technique that enables the bubble discharge properties to be improved further can be provided. Of course, edge portions in areas aside from the end of the inflow port in the arrangement direction may have a beveled shape as well.

According to another aspect of the invention, it is preferable that the liquid ejecting head include the substrate in which the common liquid chamber is formed and a second member in which is formed a second common liquid chamber that holds the liquid to be supplied to the common liquid chamber. An inflow opening that forms the inflow port in the common liquid chamber and enables the common liquid chamber and the second common liquid chamber to communicate may be formed in the substrate. The second common liquid chamber may include a second slanted surface that opposes the inflow opening at an end in the arrangement direction and is slanted so as to approach the inflow opening as the second common liquid chamber progresses toward the end in the arrangement direction. When, at an area where the inflow opening and the second common liquid chamber connect, the location of an edge portion, of the inflow opening, that is furthest at an end in the arrangement direction is indicated by P1 and the location of an edge portion of the second common liquid chamber is indicated by P2, the position P2 may be in the same position as the position P1 in the arrangement direction or may be in a position closer to the center in the arrangement direction than the position P1.

According to this aspect, a technique that enables the bubble discharge properties to be improved further can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described hereinafter. Of course, the following embodiment is merely an example of the invention, and it is not necessarily the case that all of the features described in the embodiment are required in order to achieve the advantages described above.

1. Example of Configuration of Liquid Ejecting Head

Figure 1:
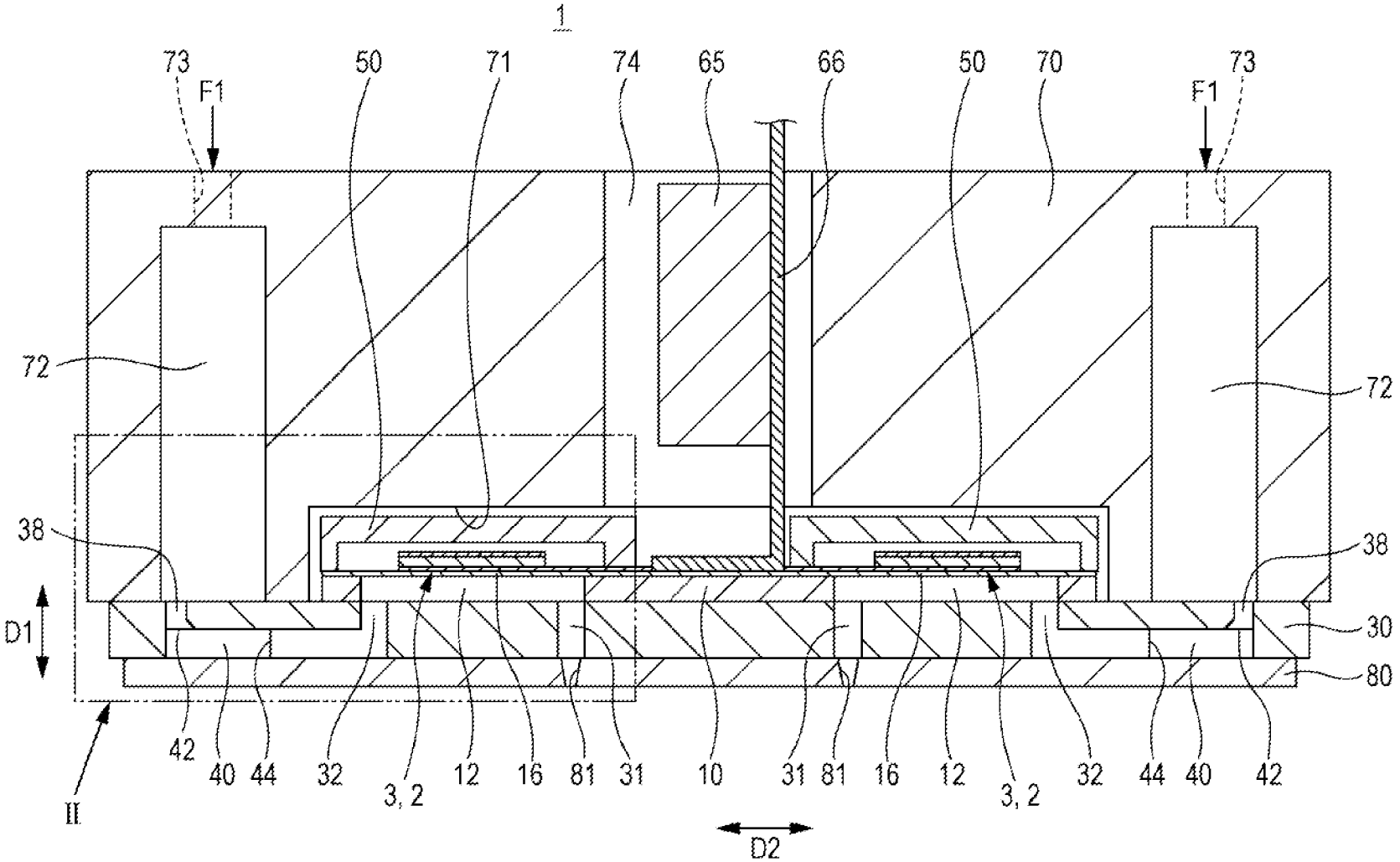
FIG. 1 is a cross-sectional view illustrating an example of a recording head.
Figure 2:
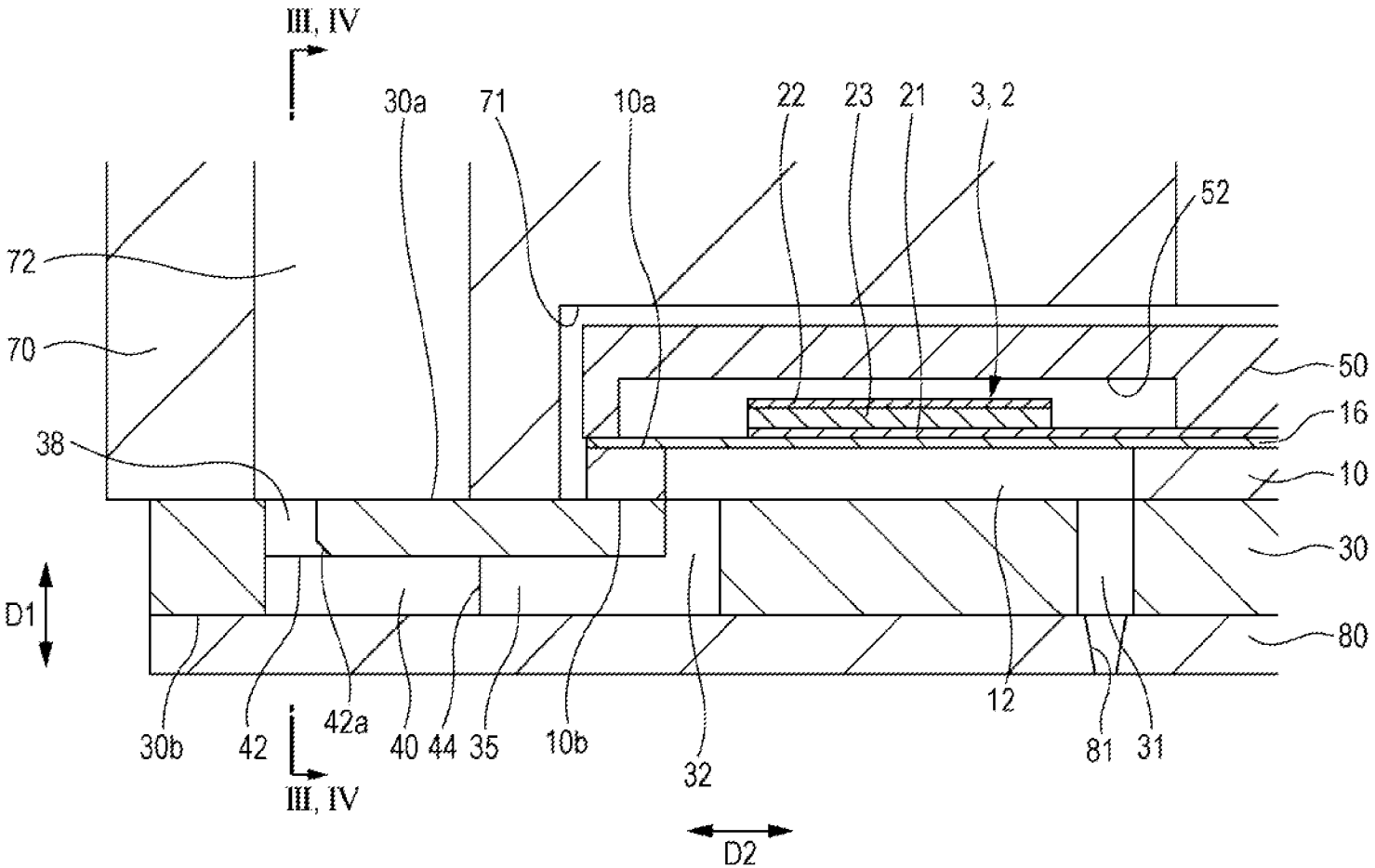
FIG. 2 is a cross-sectional view illustrating an example of the primary components of a recording head.
Figure 3:
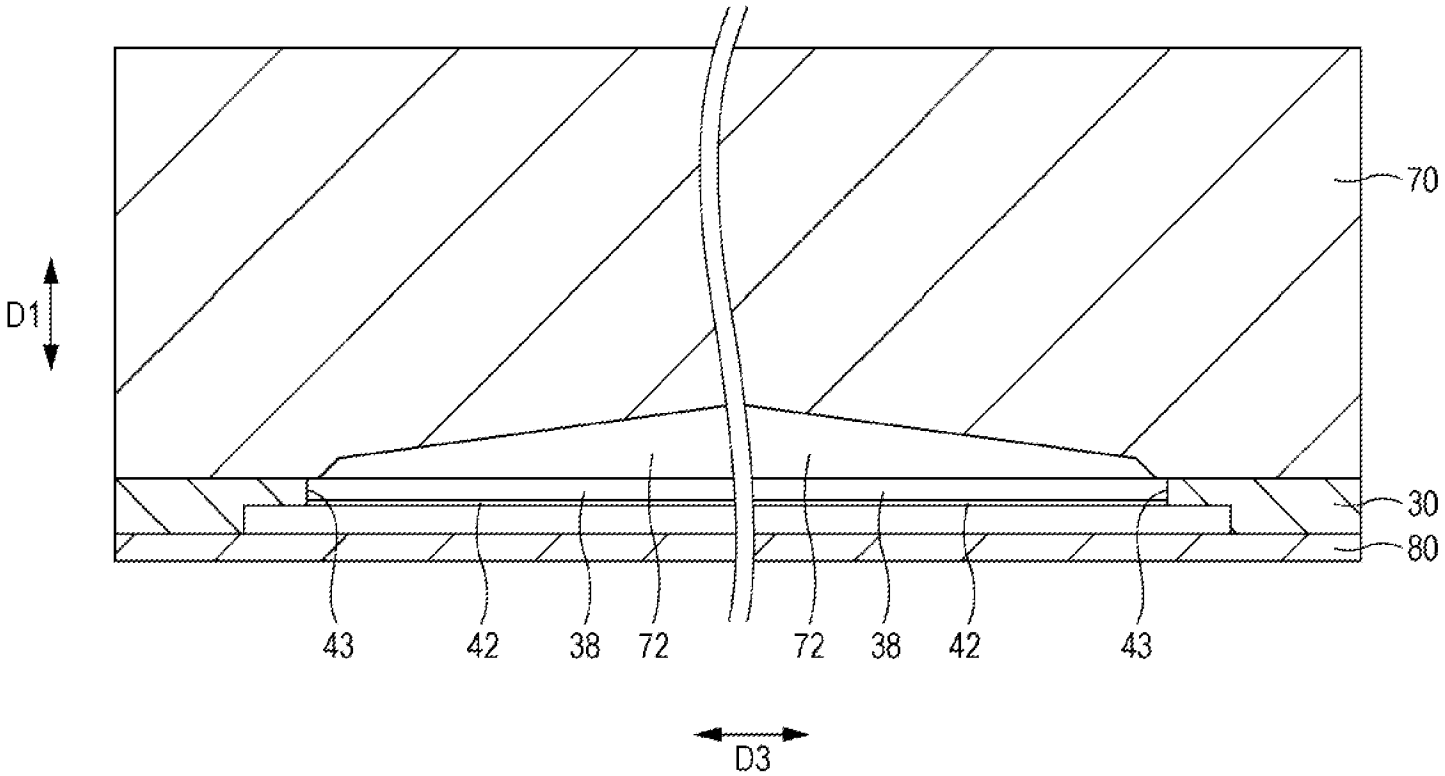
FIG. 3 is a cross-sectional view illustrating an example of a recording head from the position of a line III-III in FIG. 2.
Figure 4:
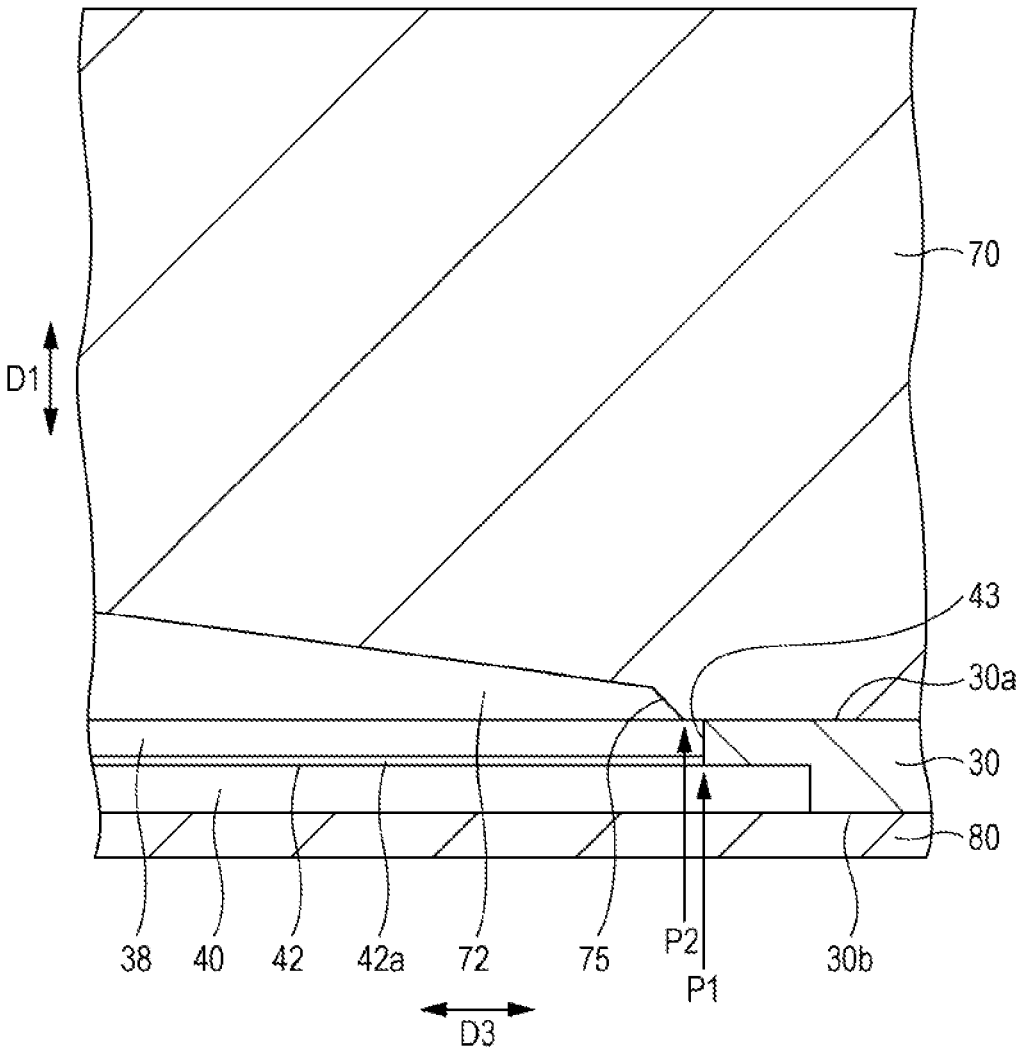
FIG. 4 is a cross-sectional view illustrating an example of the primary components of a recording head from the position of the line IV-IV in FIG. 2.
Figure 5:
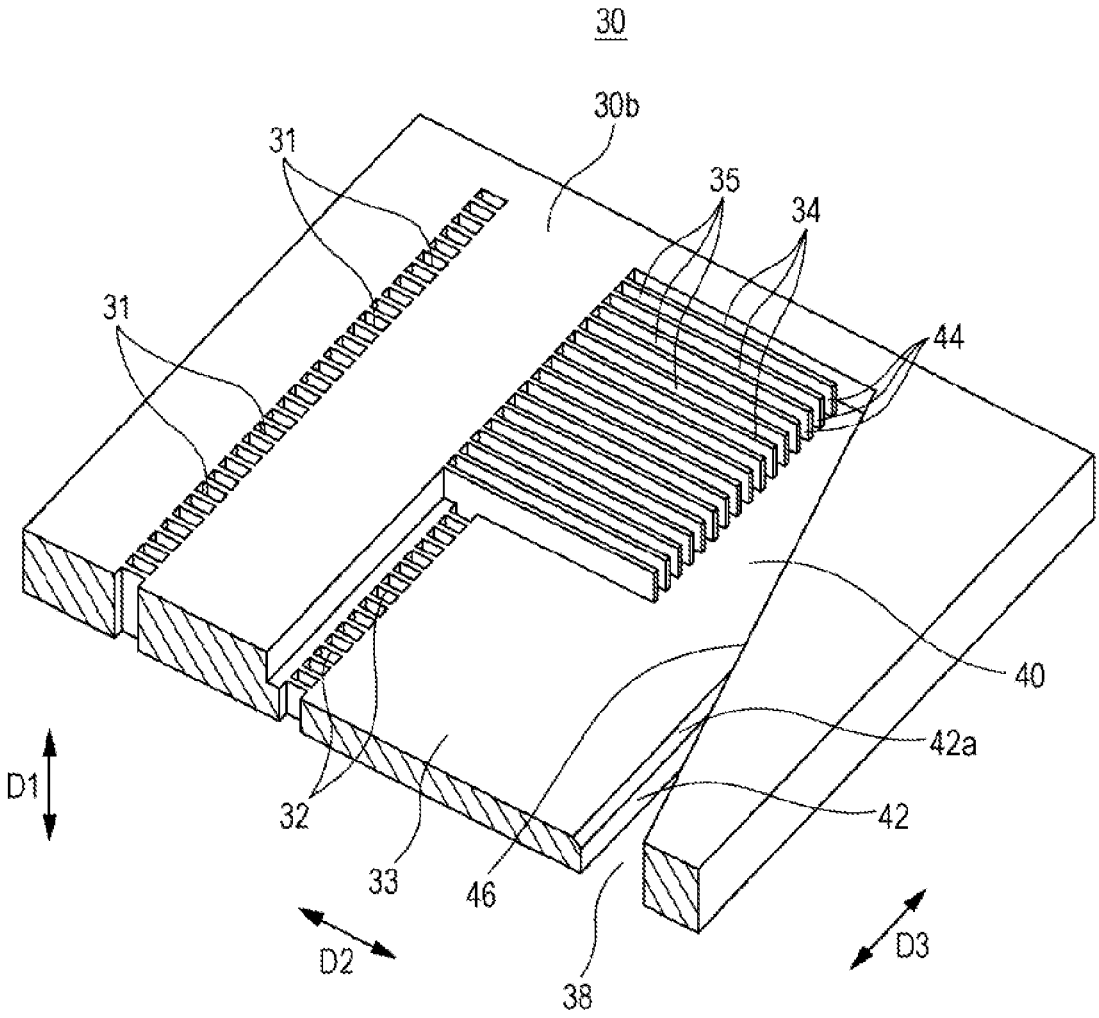
FIG. 5 is a perspective view illustrating an example of the primary components of a flow channel substrate.
Figure 6:
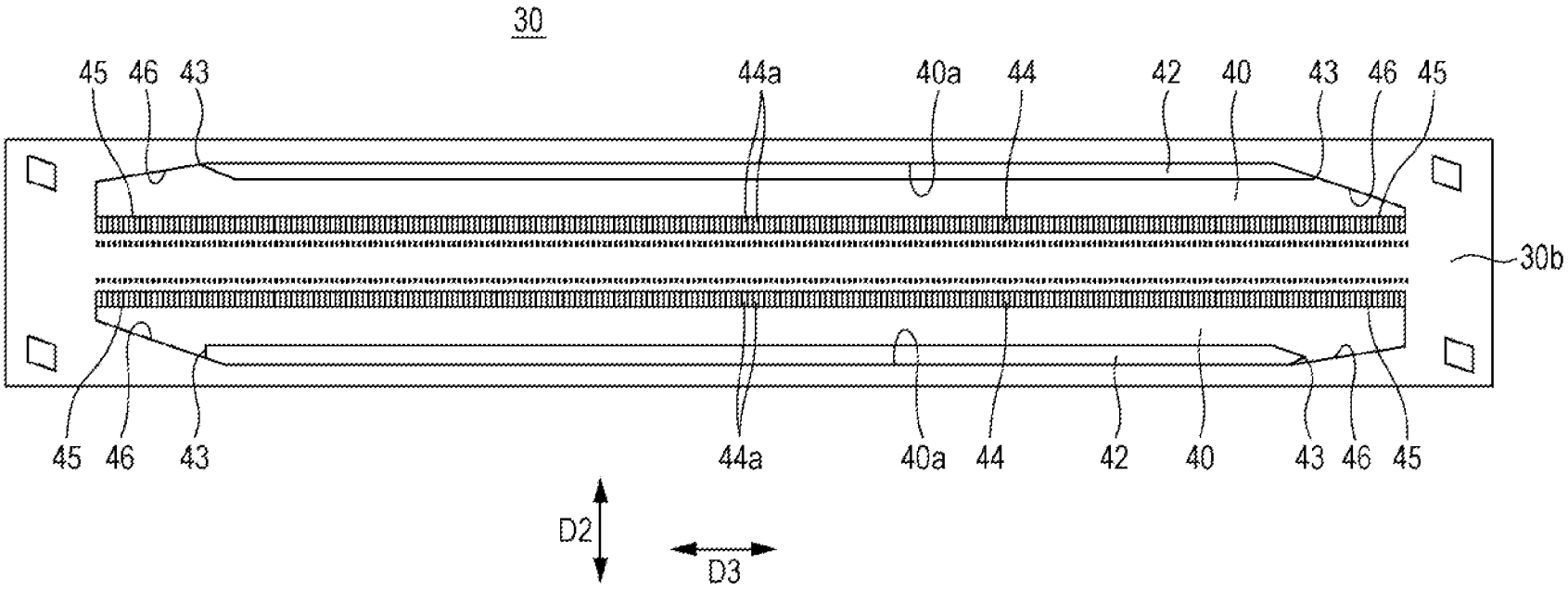
FIG. 6 is a bottom view illustrating an example of a flow channel substrate.
Figure 7:
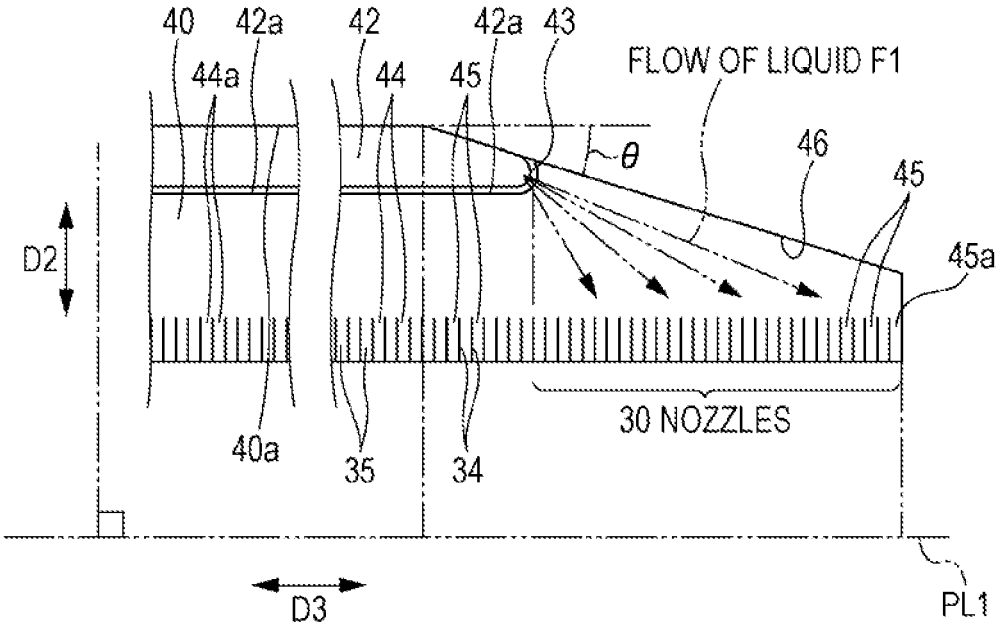
FIG. 7 is a bottom view illustrating an example of the primary components of a flow channel substrate.
Figure 11:
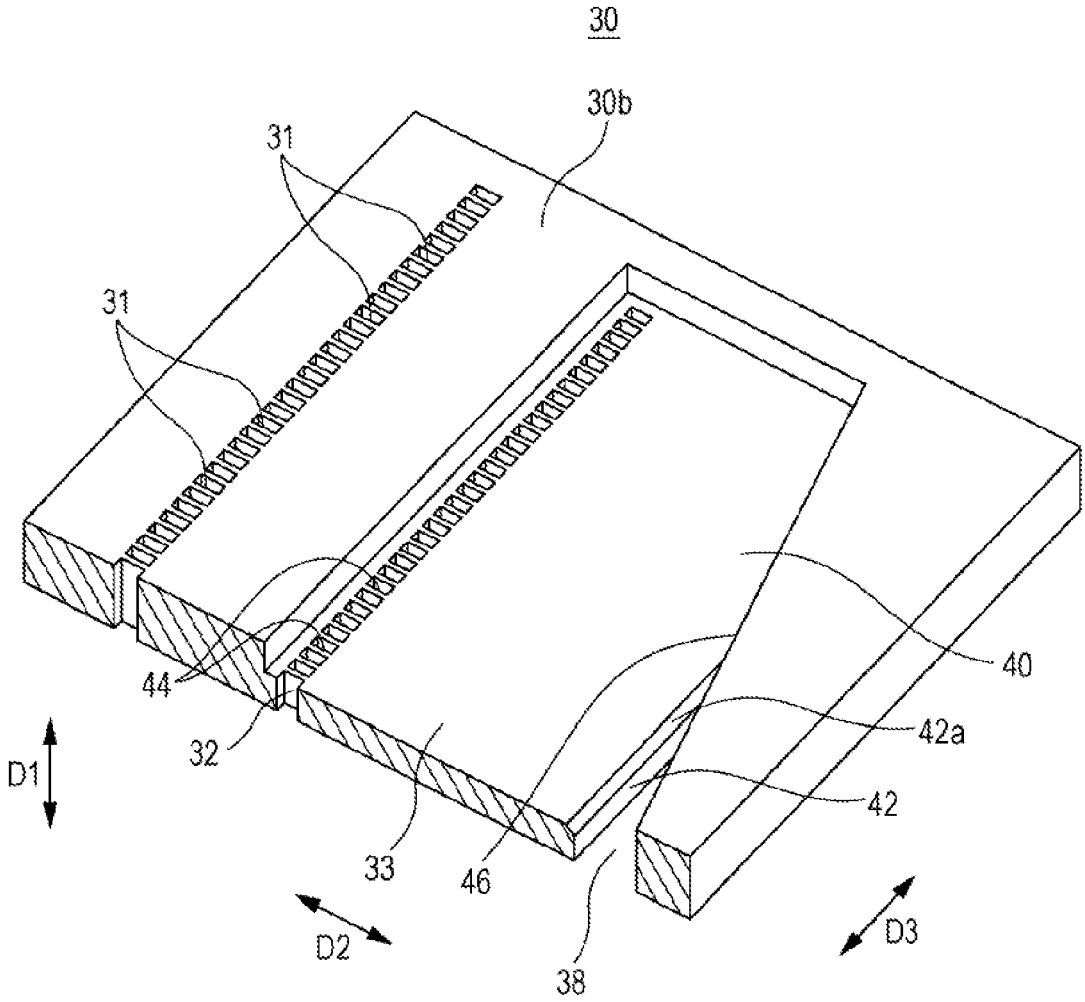
FIG. 11 is a perspective view illustrating an example of the primary components of another flow channel substrate.

FIG. 1 is a cross-sectional view illustrating an example in which an ink jet recording head 1 in which supply openings 44 are arranged as viewed from a vertical plane relative to a direction D3 (see FIG. 5). The ink jet recording head 1 serves as an example of a liquid ejecting head. FIG. 2 is a diagram illustrating an area II in FIG. 1 in an enlarged manner. FIG. 3 is a cross-sectional view illustrating an example of the recording head 1 from the position of a line III-III in FIG. 2. FIG. 4 is a diagram illustrating the primary components shown in FIG. 3 in an enlarged manner. FIG. 5 is a perspective view illustrating an example of the primary components of a nozzle plate side surface 30*b* in a flow channel substrate 30. FIG. 11 is a perspective view illustrating an example of the primary components of nozzle plate side surface 30*b* in another flow channel substrate 30. FIG. 6 is a bottom view illustrating an example of the nozzle plate side surface 30*b* in the flow channel substrate 30. FIG. 7 is a diagram illustrating the primary components shown in FIG. 6 in an enlarged manner. In FIGS. 3 and 4, the supply openings 44 and the like that are provided in the rear are not shown. In FIG. 5, individual flow channel walls 34 and the like that are provided toward the center of the direction D3 in which the supply openings are arranged are not shown.

In the stated drawings, reference numeral D1 indicates a thickness direction of a piezoelectric element 3, substrates 10, 30, and 50, a case head 70, and a nozzle plate 80. Reference numeral D2 indicates directions included in a direction that follows the flow channel substrate 30, and corresponds to, for example, a width direction of the substrates 10, 30, and 50, the case head 70, and the nozzle plate 80, as well as to a lengthwise direction of pressure chambers 12 and individual flow channels 35. Reference numeral D3 indicates the direction in which the supply openings 44 are arranged, and corresponds to, for example, the lengthwise direction of the substrates 10, 30, and 50, the case head 70, and the nozzle plate 80, as well as to the width direction of the pressure chambers 12 and the individual flow channels 35 and the direction in which the pressure chambers 12 and the individual flow channels 35 are provided. The directions D1, D2, and D3 are assumed to be orthogonal to each other, but need not be orthogonal as long as they intersect with each other. In some cases, the scaling in the directions D1, D2, and D3 differ, and do not match from drawing to drawing, in order to facilitate understanding.

Note also that the positional relationships described in this specification are merely examples for describing the invention, and are not intended to limit the invention in any way. Accordingly, the flow channel substrate may, consistent with the scope of the invention, be disposed in a position other than from underneath the pressure chambers, the case head, and so on. For instance, while still being within the scope of the invention, the flow channel substrate may be to the left, to the right, and so on, of the pressure chambers, the case head, and so on. In addition, directions, positions, and so on being "the same", "orthogonal", and so on are not intended to be taken as meaning exactly the same, perfectly orthogonal, and so on, and such descriptions are intended to include error and so on arising during production and the like. Furthermore, elements making "contact" with each other or being "affixed" to each other includes both cases where an adhesive or the like is interposed therebetween and cases where an adhesive or the like is not interposed therebetween.

The liquid ejecting head according to this technique, exemplified by the recording head 1, includes the pressure chambers 12 that communicate with corresponding nozzle openings 81, and a common liquid chamber 40 that communicates with the plurality of pressure chambers 12. The common liquid chamber 40 includes at least one inflow port 42 into which a liquid F1 flows, the plurality of supply openings 44 (arranged in a row) for supplying the liquid F1 to corresponding pressure chambers 12, and a slanted surface 46. When viewed from a second direction (D2), the slanted surface 46 is orthogonal to the arrangement direction D3 in which the plurality of supply openings 44 are arranged and that follows a substrate (30) in which the common liquid chamber 40 is formed. The slanted surface 46 is slanted so as to overlap with the arrangement of some supply openings 45 (including supply openings 45*a* located at ends of the arrangement direction D3) and so as to approach the arrangement of the said some of the supply openings 45 at the end areas of the arrangement direction D3. To describe with reference to FIG. 7, the slanted surface 46 overlapping with the arrangement of some of the supply openings 45 when viewed from the second direction (D2) means that when the slanted surface 46 and the arrangement of some of the supply openings 45 are projected in the second direction (D2) onto an imaginary plane PL1 that is orthogonal to the second direction (D2), the positions in the arrangement direction D3 match. At least part (an end 43) of the inflow port 42 is located within the arrangement of some of the supply openings 45 when viewed from the second direction (D2). To describe this with reference to FIG. 7, this means that at least part of the inflow port 42 (that is, the end 43) is within a range of the arrangement of some of the supply openings 45 in the arrangement direction D3 when the inflow port 42 and the arrangement of some of the supply openings 45 are projected in the second direction (D2) onto the imaginary plane PL1. In the liquid ejecting head, the slope of the slanted surface 46 (an angle of slope θ) and the position of the inflow port 42 are set so that a flow rate of the liquid F1 in the vicinity of the end 43 of the inflow port 42 in the arrangement direction D3 is no less than 0.025 m/s (meters per second) when a negative pressure is applied on the nozzle openings 81 and the liquid F1 is sucked from the nozzle openings 81. The liquid ejecting head improves the bubble discharge properties of a reservoir (40) by setting a shape of an end area of the reservoir (40) in the arrangement direction D3 of the supply openings 44 to a shape constricted in an area corresponding to a predetermined number of nozzles (30 nozzles, for example).

An example of the liquid ejecting apparatus (represented by a recording apparatus 200 shown in FIG. 10) includes the liquid ejecting head described above.

Figure 9:
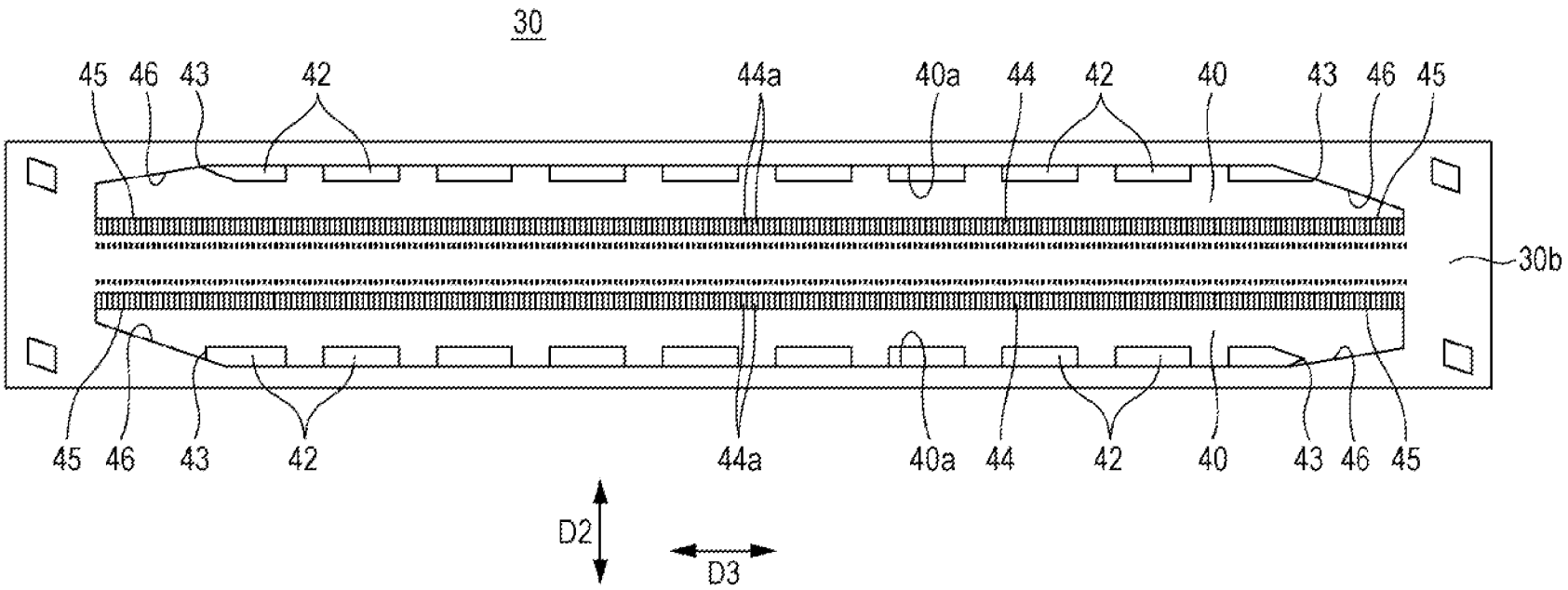
FIG. 9 is a bottom view illustrating an example of a flow channel substrate according to a variation.

Here, a single inflow port 42, having a long-hole shape such as that shown in FIG. 6, may be provided in the common liquid chamber 40. Alternatively, a plurality of the inflow ports 42 may be provided in the common liquid chamber 40 as shown in FIG. 9.

The slanted surface 46 of the common liquid chamber may be flat (as shown in FIG. 6) or may be curved.

An actuator 2 includes a piezoelectric element, a thermal element that produces bubbles within a corresponding pressure chamber by emitting heat, or the like.

The recording head 1 shown in FIGS. 1 and 2 includes a pressure chamber substrate 10 in which the piezoelectric actuators 2 are provided, a flow channel substrate (a first member) 30, a protective substrate 50, the case head (a second member) 70, the nozzle plate 80, and so on. The reservoirs (72, 40) in the recording head 1 have an upright shape. It may be more difficult to discharge bubbles from reservoirs having an upright shape than from reservoirs that do not have an upright shape. Accordingly, the recording head 1 has a structure that makes it easy to discharge bubbles that have entered the reservoir.

The individual pressure chambers 12 that correspond to respective nozzle openings 81 are formed in the pressure chamber substrate 10 shown in FIG. 2 and the like. A vibrating plate 16 is provided on a vibrating plate-side surface 10*a*. The flow channel substrate 30 is affixed to a flow channel substrate-side surface 10*b*. The pressure chamber substrate 10 and the flow channel substrate 30 are affixed using, for example, an adhesive. The vibrating plate 16 defines a wall on the piezoelectric element 3 side of the pressure chambers 12. Furthermore, a pressure chamber substrate-side surface 30*a* of the flow channel substrate 30 defines a wall on the flow channel substrate 30 side of the pressure chambers 12. The pressure chambers 12 are, for example, formed having long, approximately quadrangular shapes when viewed from above the pressure chamber substrate 10. The pressure chambers are, for example, arranged in the lengthwise direction (D3) of the pressure chamber substrate with partitions interposed therebetween.

A silicon substrate, a metal (such as stainless steel (SUS)), a ceramic material, glass, a synthetic resin, or the like can be used as the material of the pressure chamber substrate 10. As one example, the pressure chamber substrate 10 can be formed of a single-crystal silicon substrate, having a thickness is not particularly limited but is comparatively high at, for example, several hundreds of μm, and which is highly rigid. The pressure chambers 12 that are separated by a plurality of the partitions can be formed through, for example, anisotropic etching (wet etching) using an alkali solution such as a KOH aqueous solution.

The actuator 2 shown in FIG. 2 and the like includes the vibrating plate 16 and the piezoelectric element 3.

Silicon oxide ($SiO_x$), a metal oxide, a ceramic material, a synthetic resin, or the like can be used as the material of the vibrating plate 16. The vibrating plate may be formed integrally with the pressure chamber substrate by modifying the surface of the pressure chamber substrate without separation, or may be affixed to and layered upon the pressure chamber substrate. The vibrating plate may also be composed of a plurality of films. For example, a silicon oxide film (which is an elastic film) may be formed upon the silicon pressure chamber substrate, after which zirconium oxide ($ZrO_x$) (which is an insulating film) is formed upon the elastic film. The vibrating plate, whose thickness is not particularly limited but is, for example, several hundreds of nm to several μm, is thus configured as a layered film including the elastic film and the insulating film. The elastic film can be formed upon the pressure chamber substrate by, for example, thermally oxidizing a silicon wafer (for the pressure chamber substrate) in a diffusion furnace at approximately 1000 to 1200° C. The insulating film can be formed by, for example, forming a layer of zirconium (Zr) upon the elastic film through a gas-phase method such as sputtering and then thermally oxidizing the zirconium layer in a diffusion furnace at approximately 500 to 1200° C.

The piezoelectric element 3 shown in FIG. 2 includes a piezoelectric material layer 23, a lower electrode (first electrode) 21 provided on the side of the piezoelectric material layer 23 located toward the pressure chambers 12, and an upper electrode (second electrode) 22 provided on the other side of the piezoelectric material layer 23. The piezoelectric element is provided upon the vibrating plate 16. One of the electrodes 21 and 22 may be used as a common electrode. For example, FIG. 2 illustrates a state in which the lower electrode 21 acts as an individual electrode and is connected to a connection wire 66 (FIG. 1) which is a flexible board or the like, and the upper electrode 22 is connected as the common electrode. One or more of platinum (Pt), gold (Au), iridium (Ir), titanium (Ti), a conductive oxidant thereof, or the like can be used as the material of both electrodes, and although not particularly limited, the thickness can be set to, for example, approximately several nm to several hundred nm. A lead electrode configured of a conductive material such as a metal may be connected to at least one of the lower electrode and the upper electrode. A ferroelectric material such as a lead-based perovskite oxidant including PZT (lead zirconate titanate, having a theoretical mixture ratio of $Pb(Zr_x, Ti_{1-x})O_3$), or a non-lead-based perovskite oxidant can be used for the piezoelectric material layer 23, and although not particularly limited, the thickness thereof can be set to, for example, approximately several hundred nm to several μm.

The lower electrode 21, the upper electrode 22, and the lead electrode can be formed by, for example, forming an electrode film on the vibrating plate through a gas-phase method (such as sputtering) and then patterning the electrode film. The piezoelectric material layer 23 can be formed by forming a piezoelectric material precursor film on the lower electrode through a liquid-phase method (such as the spin coat method), a gas-phase method, or the like, crystallizing the film through sintering, and then patterning the resultant.

The flow channel substrate 30 shown in FIGS. 2, 3, and the like corresponds to the first member that forms a first common liquid chamber 40, and includes liquid flow channels such as individual communication openings 31 and 32 that correspond to respective nozzle openings 81, the common liquid chamber 40 that holds the liquid F1 (which is ink) to be supplied to the pressure chambers 12, and so on. The pressure chamber substrate 10 and the case head 70 are affixed to the pressure chamber substrate-side surface 30*a* of the flow channel substrate 30. The flow channel substrate 30 and the case head 70 are affixed using an adhesive, for example. The nozzle plate 80 is affixed to the nozzle plate side surface 30*b* of the flow channel substrate 30. The flow channel substrate 30 and the nozzle plate 80 are affixed using, for example, an adhesive. A member (such as a compliance sheet having compliance functionality) may be affixed to the nozzle plate side surface 30*b* of the flow channel substrate 30. The common liquid chamber 40 may be formed by the members such as the compliance sheet and the flow channel substrate 30.

A silicon substrate, a metal (such as stainless steel), a ceramic material, glass, a synthetic resin, or the like can be used as the material of the flow channel substrate 30. As one example, the flow channel substrate 30 can be formed of a single-crystal silicon substrate, having a thickness is not particularly limited but is comparatively high, and which is highly rigid. The liquid flow channels such as the communication openings 31 and 32 and the common liquid chamber 40 can be formed through, for example, anisotropic etching (wet etching) using an alkali solution such as a KOH aqueous solution.

First communication openings 31 are positioned between the pressure chambers 12 and the corresponding nozzle openings 81 of the nozzle plate 80, and enable the pressure chambers 12 and the corresponding nozzle openings 81 to communicate. Second communication openings 32 are positioned between the pressure chambers 12 and the common liquid chamber 40 of the flow channel substrate 30, and enable the pressure chambers 12 and the common liquid chamber 40 to communicate. An inflow opening 38 (for the liquid F1 to flow into the common liquid chamber 40) is a common flow channel that connects to a second common liquid chamber 72 formed in the case head 70. The inflow opening 38 enables the common liquid chambers 72 and 40 to communicate. The common liquid chambers 72 and 40 are also referred to as "reservoirs". The shape of the inflow opening 38 may include a slit shape (as exemplified in FIG. 6), as well as a circular shape, an elliptical shape, a polygonal shape, and so on. There may be one inflow opening 38, or two or more. A partially-etched area 33 (recessed from the nozzle plate side surface 30*b*) is formed in the width direction D2 of the substrate, spanning from the inflow opening 38 to the second communication openings 32. In the flow channel substrate 30 shown in FIG. 5, the flow channel walls 34 (forming the individual flow channels 35 that convey the liquid F1 in the width direction D2 of the substrate) extend from the partially-etched area 33 to the nozzle plate 80 side. The liquid F1 that flows into the common liquid chamber 40 from the inflow opening 38 enters the flow channels 35 from the individual supply openings 44, flows in the width direction D2 of the substrate, and enters the pressure chambers 12 through the communication openings 32. In the flow channel substrate 30 shown in FIG. 11, the flow channel walls 34 (and by extension the individual flow channels 35) are not provided, and thus the openings of the individual communication openings 32 formed in the common liquid chamber 40 are formed in the common liquid chamber 40 as the supply openings 44. In this case, the liquid F1 that flows into the common liquid chamber 40 from the inflow opening 38 enters the communication openings 32 from the individual supply openings 44, flows in the thickness direction D1 of the substrate, and enters the pressure chambers 12.

The common liquid chamber 40 shown in FIGS. 5 to 7 and so on includes at least one inflow port 42, the plurality of supply openings 44 arranged in a row, and the slanted surface 46 that opposes the arrangement of some of the supply openings 45 including the supply openings 45*a* located at ends in the arrangement direction D3. The inflow opening 38 (that forms the inflow port 42 in the common liquid chamber 40 and that enables the common liquid chamber 40 and the second common liquid chamber 72 to communicate) is formed in the flow channel substrate 30. The inflow port 42 can also be thought of as an opening in the inflow opening 38 formed in the common liquid chamber 40. Reference numeral 42*a* indicates an edge area of the inflow port 42, whereas reference numeral 43 indicates an end of the supply opening in the inflow port 42, in the arrangement direction D3. The inflow port 42 shown in FIGS. 5 to 7 connects to a wall surface 40*a* in the common liquid chamber 40 that opposes the arrangement of the supply openings 44. Of course, the inflow port 42 can also be separated from the wall surface 40*a*. The inflow port may be the single long hole-shaped inflow port 42 provided for the single common liquid chamber 40 as shown in FIG. 6. Alternatively, there may be a plurality of the inflow ports 42, divided along the arrangement direction D3 of the supply openings 44 and provided for the single common liquid chamber 40, as shown in FIG. 9.

As shown in FIGS. 5, 7, and so on, an edge area 42*a* in the end 43 of the inflow port 42 in the arrangement direction D3 has a beveled (tapered) shape. In FIG. 7 and so on, the edge area 42*a* of the inflow port 42 in the arrangement direction D3 in areas aside from the end 43 is also shown as having a beveled shape. The beveled shape of the edge area 42*a* of the inflow port can be formed through anisotropic etching or the like. The liquid ejecting head illustrated in FIGS. 1 to 7 improves the bubble discharge properties of the reservoir (40) by beveling the edge area 42*a* of the inflow port 42 at least at the ends 43 in the arrangement direction D3, through etching or the like.

The supply openings 44 can also be thought of as openings in the individual flow channels formed in the common liquid chamber 40. With the flow channel substrate 30 shown in FIGS. 2 and 5, opening areas of the individual flow channels 35 correspond to the supply openings 44. In this case, the supply openings 44 oppose the wall surface 40*a* of the common liquid chamber 40. With the flow channel substrate 30 shown in FIG. 11, opening areas of the individual communication openings 32 correspond to the supply openings 44. In this case, the supply openings 44 oppose a portion that closes off the common liquid chamber 40 on the opposite side as the partially-etched area 33 (the nozzle plate 80, for example). Reference numeral 44*a* indicates supply openings in the center of the arrangement direction D3. When the number of supply openings 44 arranged in the arrangement direction D3 is taken as N (where N is an integer of 3 or more), the supply opening 44*a* in the center refers to the {(N+1)/2}th supply opening from the end in the case where N is an odd number, and refers to the (N/2)th supply opening and the {(N/2)+1} supply opening from the end in the case where N is an even number.

The slanted surface 46 is slanted so as to approach the arrangement of the aforementioned some of the supply openings 45 as the slanted surface 46 approaches the ends of the supply openings 44 in the arrangement direction D3. This "slanting" also includes slanting in which the side on the ends of the supply openings 44 in the arrangement direction D3 approaches the arrangement of some of the supply openings 45. As illustrated in FIG. 7, the angle of slope θ of the slanted surface 46 is an angle formed between the arrangement direction D3 of the supply openings 44 and the slanted surface 46 at a plane perpendicular to the thickness direction D1 of the flow channel substrate 30. At least part (the end 43) of the inflow port 42 shown in FIGS. 5 to 7 is provided between the arrangement of some of the supply openings 45 and the slanted surface 46, and is located within the range of the arrangement of some of the supply openings 45 when viewed from the second direction (D2). At least part (the end 43) of the inflow port 42 shown in FIG. 11 is located within the arrangement of some of the supply openings 45 when viewed from the second direction (D2).

The protective substrate 50 shown in FIG. 2 and the like includes a space forming area 52 in regions that oppose active portions of the piezoelectric elements 3. The protective substrate 50 is affixed upon the pressure chamber substrate 10 on which the piezoelectric elements 3 are formed. The protective substrate 50 and the pressure chamber substrate 10 on which the piezoelectric elements 3 are provided are affixed using, for example, an adhesive. The space forming area 52 has a space that ensures there will be no interference with the movement of the active portions of the piezoelectric elements 3. A silicon substrate, a metal (such as stainless steel), a ceramic material, glass, a synthetic resin, or the like can be used as the material of the protective substrate 50. As one example, the protective substrate 50 can be formed of a single-crystal silicon substrate, having a thickness is not particularly limited but is comparatively high at, for example, several hundreds of μm, and which is highly rigid.

The case head 70 shown in FIG. 1 and the like corresponds to the second member, in which is formed the second common liquid chamber 72 that holds the liquid F1 to be supplied to the first common liquid chamber 40 and subsequently to the pressure chambers 12. The case head 70 includes a space forming area 71 located in a region that opposes the protective substrate 50. The case head 70 also includes a gap 74 through which the connection wire 66 is passed. The case head 70 is affixed to the flow channel substrate 30. The space forming area 71 has a space in which the protective substrate 50 is accommodated. The second common liquid chamber 72 holds the liquid F1 that has flowed in from a liquid introduction portion 73. The pressure chamber substrate-side surface 30*a* of the flow channel substrate 30 defines part of the walls of the pressure chambers 12 as well as part of the walls of the second common liquid chamber 72. Glass, a ceramic material, a metal (such as stainless steel), a synthetic resin, a silicon substrate, or the like can be used as the material of the case head 70.

The second common liquid chamber 72 shown in FIGS. 3, 4, and so on has a second slanted surface 75 that opposes the inflow opening 38 at the end 43 of the supply openings 44 in the arrangement direction D3. The second slanted surface 75 is slanted so as to approach the inflow opening 38 as the second common liquid chamber 72 progresses toward the end in the arrangement direction D3. This "slanting" also includes slanting in which the side on the ends of the supply openings 44 in the arrangement direction D3 approaches the inflow opening 38. Here, as shown in FIG. 4, at an area where the inflow opening 38 and the second common liquid chamber 72 connect, the position of an edge portion, of the inflow opening 38, that is furthest at the end thereof in the arrangement direction D3 is indicated by P1, and the position of an edge portion of the second common liquid chamber 72 is indicated by P2. In the arrangement direction D3 of the supply openings 44, the position P2 of the edge of the common liquid chamber 72 is in the same position as the position P1, or, as shown in FIG. 4 and the like, is in a position further toward the center in the arrangement direction D3 than the position P1. The position of the edge portion of the common liquid chamber 72 in the arrangement direction D3 matches the position P1 of the edge portion furthest to the end in the arrangement direction D3 of the inflow opening 38, or is positioned on an inner side of the inflow opening 38, which also makes it difficult for liquid, and by extension bubbles, to accumulate in the reservoir (72), and provides favorable bubble discharge properties.

A driving circuit 65 shown in FIG. 1 drives the piezoelectric elements 3 via the connection wire 66. A circuit board, a semiconductor integrated circuit (IC), or the like can be used as the driving circuit 65. A flexible board or the like can be used for the connection wire 66.

The nozzle plate 80 shown in FIG. 2 and the like has a plurality of nozzle openings 81 that pass therethrough in the thickness direction D1, and is affixed to the flow channel substrate 30. A metal (such as stainless steel), glass, a ceramic material, a synthetic resin, a silicon substrate, or the like can be used as the material of the nozzle plate 80. As one example, the nozzle plate 80 can be formed from a glass ceramic material having a thickness, while not particularly limited, is approximately 0.01 to 1 mm.

The recording head 1 imports ink (serving as the liquid F1) from the liquid introduction portion 73 connected to an external liquid supply unit (not shown), and fills the interior with the liquid F1 from the second common liquid chamber 72, through the inflow opening 38, the common liquid chamber 40, the individual flow channels 35, the second communication openings 32, the pressure chambers 12, and the first communication openings 31, and to the nozzle openings 81. When a voltage is applied between the lower electrode 21 and the upper electrode 22 in each of the pressure chambers 12 based on recording signals from the driving circuit 65, pressure is applied within each pressure chamber 12 as a result of the piezoelectric material layer 23, the lower electrode 21, and the vibrating plate 16 deforming, which in turn ejects ink droplets, serving as liquid droplets, from the nozzle openings 81.

Incidentally, when bubbles enter into the common liquid chamber 40 that communicates with the plurality of pressure chambers 12, the bubbles may enter the individual flow channels leading to the nozzle openings 81 during recording due to the ink (serving as the liquid F1) being ejected. As a result, the liquid droplets may not be ejected from the nozzle openings 81, causing a drop in the quality of the recorded material.

Accordingly, a cleaning process (in which a negative pressure is applied to the nozzle openings 81 in order to forcefully suck the liquid F1 from the nozzle openings 81) is carried out to discharge the bubbles from within the common liquid chamber 40.

Figure 8:
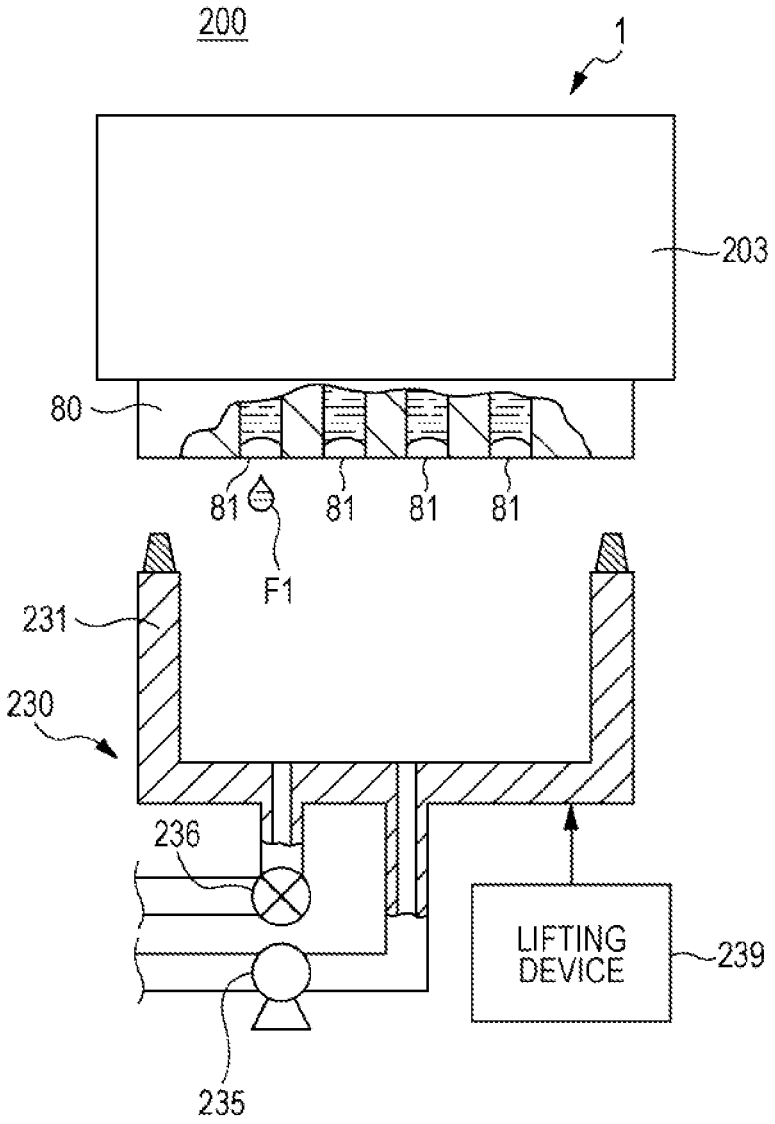
FIG. 8 is a diagram schematically illustrating an example of the primary components of a recording apparatus having a cleaning device.

FIG. 8 is a diagram schematically illustrating an example of the primary components of the recording apparatus 200 that has a cleaning device 230 for carrying out the stated cleaning process. The cleaning device 230 includes a cap 231, a suction pump 235, an atmospheric release valve 236, and a lifting device 239. The cleaning device 230 is provided in a location that opposes a home position at one end of a platen 208 (see FIG. 10). The cleaning device 230 has a capping function. In the capping function, the recording head 1 is moved to the home position that is opposite to the cap 231 when printing is not being carried out, the cap 231 is lifted by the lifting device 239, and the nozzle plate 80 is sealed by the cap 231, in order to suppress the ink within the nozzles from thickening (drying). During the cleaning, the cleaning device 230 forcefully sucks ink from the nozzle openings 81 by closing the atmospheric release valve 236 with the nozzle plate 80 in a sealed state, driving the suction pump 235, and depressurizing an internal space formed between the recording head 1 and the cap 231 to, for example, approximately −20 kPa to −60 kPa (−0.2 atm to −0.6 atm).

In recent years, there is increased demand for the reservoir to be configured at smaller sizes in order to miniaturize the recording head. However, when the size of the reservoir is reduced, the flow channels are by nature also narrowed as a result, making it easier for bubbles to accumulate within the reservoir. Accordingly, bubbles within the reservoir may not be discharged even if the cleaning process is carried out. By carrying out experiments using a liquid ejecting head having the flow channel substrate illustrated in FIGS. 5 and 11, it was discovered that a flow rate (V1) of the liquid F1 in the vicinity of the end 43 of the inflow port 42 in the arrangement direction D3 changes when the liquid F1 is sucked from the nozzle openings 81 by imparting a negative pressure on the nozzle openings 81. This was due to the slope of the slanted surface 46 that opposes the arrangement of some of the supply openings 45; the positional relationships between the arrangement of the supply openings 45, the slanted surface 46, and the inflow port 42; the cross-sectional area of the flow channels; and the amount of liquid ejected. It was also seen that the bubble discharge properties were greatly influenced by the flow rate V1 of the liquid as a result of adjusting the slope of the slanted surface 46; the positional relationships between the arrangement of the supply openings 45, the slanted surface 46, and the inflow port 42; the cross-sectional area of the flow channels; and the amount of liquid ejected.

To describe this with reference to FIG. 7, when the angle (θ) of the slanted surface 46 and the position of the inflow port 42 are set so that the flow rate V1 of the liquid F1 (in the vicinity of the end 43 of the inflow port 42 in the arrangement direction D3) when the liquid F1 is sucked from the nozzle openings 81 by imparting a negative pressure on the nozzle openings 81 is no less than 0.025 m/s, the bubbles within the common liquid chamber 40 are favorably discharged. The bubbles within the common liquid chamber 40 are further favorably discharged when the angle (θ) of the slanted surface 46 and the position of the inflow port 42 are set so that the flow rate V1 is no less than 0.03 m/s. On the other hand, the discharge properties for bubbles within the common liquid chamber 40 are not favorable when the angle (θ) of the slanted surface 46 and the position of the inflow port 42 are set so that the flow rate V1 is less than 0.025 m/s.

Note that the end 43 of the inflow port 42 may be disposed, for example, toward the center in the arrangement direction D3 of the supply openings 44 (toward the left, in FIG. 7) in order to increase the flow rate V1. It is thought that this is because there is a greater number of supply openings 44 that pull the liquid F1 from the vicinity of the end 43 of the inflow port. FIG. 7 shows an example in which 30 supply openings 44 (counted from the supply opening 45*a* on the end) pull the liquid F1 from the vicinity of the end 43 of the inflow port. In order to further increase the flow rate V1, for example, the number of supply openings 44 from the supply opening 45*a* on the end to the end 43 of the inflow port in the arrangement direction D3 may be increased. On the other hand, the end 43 of the inflow port may be disposed, for example, toward an end in the arrangement direction D3 (toward the right, in FIG. 7) in order to reduce the flow rate V1. It is thought that this is because there is a smaller number of supply openings 44 that pull the liquid F1 from the vicinity of the end 43 of the inflow port. Of course, the flow rate V1 may be varied by varying the magnitude of the angle (θ) of the slanted surface 46 or the like.

The flow rate V1 can be measured by, for example, using a dedicated experimental liquid ejecting head provided with a sensor for detecting the flow rate of the liquid F1 in the vicinity of the end 43 of the inflow port. When such an experimental liquid ejecting head is manufactured and the liquid F1 is passed through the experimental liquid ejecting head, the flow rate V1 can be measured by the sensor during cleaning, when the liquid F1 is sucked from the nozzle openings 81 by imparting a negative pressure on the nozzle openings 81. Alternatively, a simulation may be carried out to predict the flow rate V1 under conditions where the liquid F1 is sucked from the nozzle openings 81 by imparting a negative pressure on the nozzle openings 81. The measured value or predicted value for the flow rate V1 that is obtained can be used when setting the angle (θ) of the slanted surface 46 and the position of the inflow port 42.

Here, although increasing the flow rate V1 of the liquid F1 makes it difficult for bubbles to accumulate, it is also thought that increasing the flow rate V1 excessively may result in an excessive difference, from nozzle to nozzle, in pressure loss from the reservoir to the nozzle openings, which may in turn result in a drop in the quality of the recorded material. Accordingly, the angle (θ) of the slanted surface 46 and the position of the inflow port 42 may be set based on the difference in the pressure loss from nozzle to nozzle (a difference in resistance). For example, during printing, which is recording by ejecting the liquid F1 from the nozzle openings 81, the pressure loss from the inflow port 42 up to the nozzle opening 81 that communicates with the supply opening 45*a* at the end of the plurality of supply openings 44 in the arrangement direction D3 is represented by ΔP1, and the pressure loss from the inflow port 42 up to the nozzle opening 81 that communicates with the supply opening 44*a* at the center of the plurality of supply openings 44 in the arrangement direction D3 is represented by ΔP2. "Printing" includes situations with a comparatively low duty, such as printing text, and situations with a comparatively high duty, such as printing solid colors, photographs, or the like. "Duty" refers to the usage frequency of the nozzles; nozzles that eject liquid droplets at all of the timings in a predetermined number of ejection timings, as with printing solid colors, have a duty of 100%, whereas nozzles that eject liquid droplets, for example, once out of two ejecting timings have a duty of 50%. Flushing (which refers to ejecting liquid for purposes aside from the original application of the liquid droplets, or in other words, for purposes aside from printing) is not considered to be included in the "printing". During flushing, the recording head 1 is, for example, moved relatively to a position that does not oppose a recording medium, namely the home position, and ejects ink droplets along with bubbles, thickened ink, and the like from the nozzle openings 81.

When the angle (θ) of the slanted surface 46 and the position of the inflow port 42 are set so that a difference ΔP1−ΔP2 between the pressure losses ΔP1 and ΔP2 is no greater than 300 Pa, there is a sufficiently small difference between the liquid ejections from the nozzle opening that communicates with the supply opening 45*a* on the end and the liquid ejections from the nozzle opening that communicates with the supply opening 44*a* in the center. The quality of the recorded material can be improved as a result.

Note that the end 43 of the inflow port 42 may be disposed, for example, toward an end in the arrangement direction D3 of the supply openings 44 (toward the right, in FIG. 7) in order to reduce the difference between the pressure losses ΔP1 and ΔP2. It is thought that this is because the distance between the supply opening 45*a* on the end and the inflow port 42 is greater than the distance between a given supply opening 44 and the inflow port 42, in the direction D2 that is orthogonal to the arrangement direction D3, and the difference between the pressure losses ΔP1 and ΔP2 decreases as the end 43 of the inflow port is brought closer to the supply opening 45*a* on the end. Because the flow rate V1 may drop when the difference between the pressure losses ΔP1 and ΔP2 is reduced, it can also become necessary to increase the difference between the pressure losses ΔP1 and ΔP2. Note that the end 43 of the inflow port may be disposed, for example, toward the center in the arrangement direction D3 of the supply openings 44 (toward the left, in FIG. 7) in order to increase the difference between the pressure losses ΔP1 and ΔP2. Of course, the difference between the pressure losses ΔP1 and ΔP2 may be varied by varying the degree of the angle (θ) of the slanted surface 46 or the like.

The pressure losses ΔP1 and ΔP2 can be measured by, for example, using a dedicated experimental liquid ejecting head provided with a sensor for detecting the pressure losses ΔP1 and ΔP2. When such an experimental liquid ejecting head is manufactured and the liquid F1 is passed through the experimental liquid ejecting head, the pressure losses ΔP1 and ΔP2 can be measured by the sensor during printing, when recording is carried out by ejecting the liquid F1 from the nozzle openings 81. Alternatively, a simulation may be carried out to predict the pressure losses ΔP1 and ΔP2 under conditions of recording in which the liquid F1 is ejected from the nozzle openings 81. The measured value or predicted value for the pressure losses ΔP1 and ΔP2 that is obtained can be used when setting the angle (θ) of the slanted surface 46 and the position of the inflow port 42.

Although a number (Ne) of supply openings 44 from the end (45*a*) of the plurality of supply openings 44 in the arrangement direction D3 to the end 43 of the inflow port 42 in the arrangement direction D3 may be any number at which V1≥0.025 m/s, it is preferable for the number to be 30 or more, and further preferable for the number to be 30. The bubble discharge properties from the common liquid chamber 40 are further improved when the number Ne of supply openings is 30 or more, and are particularly improved when the number Ne of supply openings is 30.

Note that the same trends in the flow rate V1 and the difference between the pressure losses ΔP1 and ΔP2 are seen in both the liquid ejecting heads having the flow channel substrates shown in FIGS. 5 and 11.

2. Liquid Ejecting Apparatus

Figure 10:
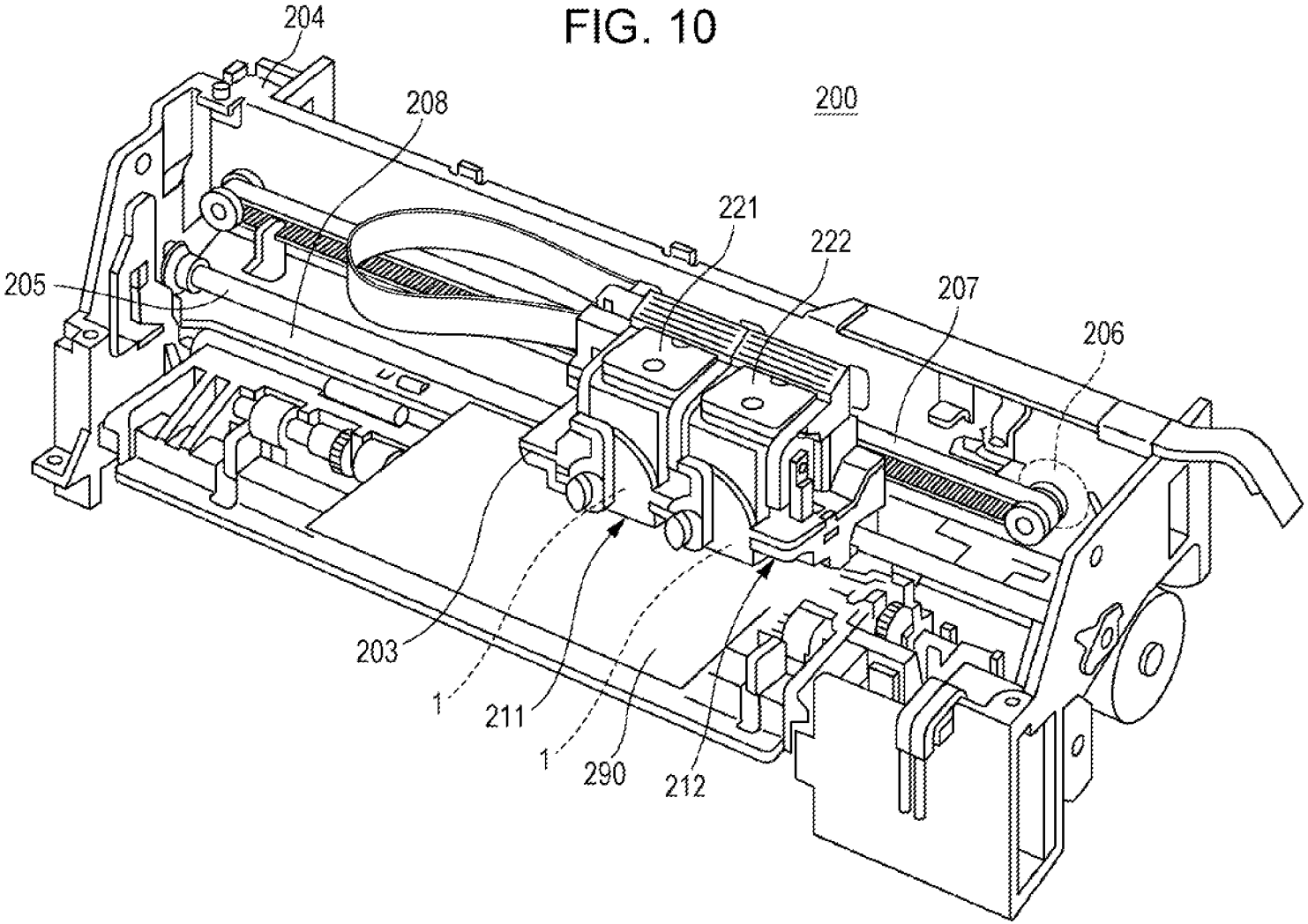
FIG. 10 is a perspective view illustrating the overall configuration of a recording apparatus.

FIG. 10 illustrates an external view of the ink jet recording apparatus (liquid ejecting apparatus) 200 having the aforementioned recording head 1. The recording apparatus 200 can be manufactured by incorporating the recording head 1 into recording head units 211 and 212. In the recording apparatus 200 shown in FIG. 10, the recording head 1 is provided in each of the recording head units 211 and 212. Furthermore, ink cartridges 221 and 222, serving as external ink supply units, are provided as well in a removable state. A carriage 203 (in which the recording head units 211 and 212 are mounted) is provided so as to be capable of moving back and forth along a carriage shaft 205 provided within a main apparatus body 204. The carriage 203 moves along the carriage shaft 205 when driving force from a driving motor 206 is transmitted to the carriage 203 via a plurality of gears (not shown) and a timing belt 207. A recording sheet 290 fed by a paper feed roller and the like (not shown) is transported onto the platen 208, and printing is carried out thereon by the ink (liquid) supplied from the ink cartridges 221 and 222 and ejected from the recording head 1.

3. Test Example

Table 1 indicates results of evaluating the bubble discharge properties when varying the flow rate of the ink in the vicinity of the end 43 of the inflow port 42 in the arrangement direction D3 during cleaning performed by the experimental liquid ejecting head having flow channel substrates such as those shown in FIGS. 5 and 11.

TABLE 1

| INK FLOW RATE (m/s) | EVALUATION RESULT |
|---|---|
| 0.06 | VERY GOOD |
| 0.04 | VERY GOOD |
| 0.03 | VERY GOOD |
| 0.025 | GOOD |
| 0.02 | FAIR |
| 0.01 | POOR |

VERY GOOD: no occurrence
GOOD: one or fewer occurrences every two to three sets
FAIR: average of one or more occurrences every two to three sets
POOR: average of one or more occurrences every set Here, printing a solid color onto ten sheets of A4 print paper was used as a single set of a printing test, and the frequency with which missing dots, in which no ink droplet was ejected from the nozzle opening, occurred was then evaluated. Each test set evaluated both a dye-based and a pigment-based ink having a normal surface tension of 25 to 35 mN/m.

As shown in Table 1, when the flow rate V1 of the ink was 0.01 m/s, an average of one or more missing dots was observed in each set. When the flow rate V1 of the ink was 0.02 m/s, an average of one or more missing dots was observed every two to three sets. When the flow rate V1 of the ink reached 0.025 m/s, there were one or fewer missing dots every two to three sets. Accordingly, it can be seen that the bubbles within the common liquid chamber are favorably discharged when the angle (θ) of the slanted surface 46 and the position of the inflow port 42 are set so that the flow rate V1 is no less than 0.025 m/s, regardless of whether a dye-based or pigment-based ink is used.

Furthermore, no missing dots were observed when the flow rate V1 of the ink was greater than or equal to 0.03 m/s. Accordingly, it can be seen that the bubbles within the common liquid chamber are further favorably discharged when the angle (θ) of the slanted surface 46 and the position of the inflow port 42 are set so that the flow rate V1 is no less than 0.03 m/s, regardless of whether a dye-based or pigment-based ink is used.

Note that the same applies to highly viscous ink as well.

4. Variations

Many variations can be considered for the invention.

For example, the liquid ejected from the liquid ejecting head includes fluids such as solutions in which dyes or the like have been dissolved in a solvent, sols in which solid particles such as pigments, metal particles, and so on have been dispersed in a carrier fluid, and the like. Such fluids include inks, liquid crystals, and the like. In addition to image recording apparatuses such as printers, the liquid ejecting head can be installed in devices that manufacture color filters for liquid-crystal displays and the like, devices for manufacturing electrodes for organic EL displays and the like, biochip manufacturing devices, and so on.

The protective substrate may be omitted, or may be integrated with the case head.

The nozzle plate may be integrated with the flow channel substrate.

5. Conclusion

As described thus far, according to the invention, a technique and the like for a liquid ejecting head capable of improving bubble discharge properties can be provided through a variety of embodiments. Of course, the aforementioned basic actions and effects can also be achieved by a technique or the like that employs only the constituent elements denoted in the independent aspects of the invention and does not employ the constituent elements denoted in the dependent aspects of the invention.

Furthermore, a configuration in which the configurations disclosed in the stated embodiments and variations are replaced with each other or the combinations thereof are modified, a configuration in which configurations from known techniques as well as configurations disclosed in the stated embodiments and variations are replaced with each other or the combinations thereof are modified, and so on can also be employed. Such configurations also fall within the scope of the invention.

The entire disclosure of Japanese Patent Application No: 2013-160167, filed Aug. 1, 2013 is expressly incorporated by reference herein in its entirety.

What is claimed is:

1. A liquid ejecting head comprising:

a pressure chamber that communicates with a nozzle opening; and a common liquid chamber that communicates with a plurality of the pressure chambers, the common liquid chamber including:

at least one inflow port into which a liquid flows;

a plurality of supply openings, arranged in a row, for supplying the liquid to each of the pressure chambers; and a slanted surface that, when viewed from a second direction that is orthogonal to an arrangement direction in which the plurality of supply openings are arranged and that follows a substrate in which the common liquid chamber is formed, is slanted so that the slanted surface overlaps with the arrangement of some of the supply openings including supply openings located at ends of the arrangement direction and approaches the arrangement of the supply openings at the end areas of the arrangement direction, at least some of the inflow ports being within a range of the arrangement of the stated some of the supply openings when viewed from the second direction; and a slope of the slanted surface and a position of the inflow port being set so that a flow rate of the liquid is no less than 0.025 m/s in the vicinity of an end of the inflow port in the arrangement direction when the liquid is sucked from the nozzle openings by applying negative pressure to the nozzle openings.

2. The liquid ejecting head according to claim 1, wherein the slope of the slanted surface and the position of the inflow port are set so that the flow rate of the liquid is no less than 0.03 m/s in the vicinity of the end of the inflow port in the arrangement direction when the liquid is sucked from the nozzle openings by applying negative pressure to the nozzle openings.

3. The liquid ejecting head according to claim 1, wherein there are 30 supply openings from an end of the plurality of supply openings in the arrangement direction to an end of the inflow port in the arrangement direction.

4. The liquid ejecting head according to claim 1, wherein the slope of the slanted surface and the position of the inflow port are set so that during recording by ejecting the liquid from the nozzle openings, there is a difference of no more than 300 Pa between a pressure loss from the inflow port up to the nozzle opening that communicates with the supply opening at the end of the plurality of supply openings in the arrangement direction and a pressure loss from the inflow port up to the nozzle opening that communicates with a supply opening in a center of the plurality of supply openings in the arrangement direction.

5. The liquid ejecting head according to claim 1, wherein an edge portion at the end of the inflow port in the arrangement direction has a beveled shape.

6. The liquid ejecting head according to claim 1, further comprising:

the substrate in which the common liquid chamber is formed; and a second member in which is formed a second common liquid chamber that holds the liquid to be supplied to the common liquid chamber, wherein an inflow opening that forms the inflow port in the common liquid chamber and enables the common liquid chamber and the second common liquid chamber to communicate is formed in the substrate;

the second common liquid chamber includes a second slanted surface that opposes the inflow opening at an end in the arrangement direction and is slanted so as to approach the inflow opening as the second common liquid chamber progresses toward the end in the arrangement direction; and when, at an area where the inflow opening and the second common liquid chamber connect, the location of an edge portion, of the inflow opening, that is furthest at an end in the arrangement direction is indicated by P1 and the location of an edge portion of the second common liquid chamber is indicated by P2, the position P2 is in the same position as the position P1 in the arrangement direction or is in a position closer to the center in the arrangement direction than the position P1.

7. A liquid ejecting apparatus comprising a liquid ejecting head, the liquid ejecting head comprising:

a pressure chamber that communicates with a nozzle opening; and a common liquid chamber that communicates with a plurality of the pressure chambers, the common liquid chamber including:

at least one inflow port into which a liquid flows;

a plurality of supply openings, arranged in a row, for supplying the liquid to each of the pressure chambers; and a slanted surface that, when viewed from a second direction that is orthogonal to an arrangement direction in which the plurality of supply openings are arranged and that follows a substrate in which the common liquid chamber is formed, is slanted so that the slanted surface overlaps with the arrangement of some of the supply openings including supply openings located at ends of the arrangement direction and approaches the arrangement of the supply openings at the end areas of the arrangement direction, at least some of the inflow ports being within a range of the arrangement of the stated some of the supply openings when viewed from the second direction; and a slope of the slanted surface and a position of the inflow port being set so that a flow rate of the liquid is no less than 0.025 m/s in the vicinity of an end of the inflow port in the arrangement direction when the liquid is sucked from the nozzle openings by applying negative pressure to the nozzle openings.

8. The liquid ejecting apparatus in accordance with claim 7, wherein the slope of the slanted surface and the position of the inflow port are set so that the flow rate of the liquid is no less than 0.03 m/s in the vicinity of the end of the inflow port in the arrangement direction when the liquid is sucked from the nozzle openings by applying negative pressure to the nozzle openings.

9. The liquid ejecting apparatus in accordance with claim 7, wherein there are 30 supply openings from an end of the plurality of supply openings in the arrangement direction to an end of the inflow port in the arrangement direction.

10. The liquid ejecting apparatus in accordance with claim 7, wherein the slope of the slanted surface and the position of the inflow port are set so that during recording by ejecting the liquid from the nozzle openings, there is a difference of no more than 300 Pa between a pressure loss from the inflow port up to the nozzle opening that communicates with the supply opening at the end of the plurality of supply openings in the arrangement direction and a pressure loss from the inflow port up to the nozzle opening that communicates with a supply opening in a center of the plurality of supply openings in the arrangement direction.

11. The liquid ejecting apparatus in accordance with claim 7, wherein an edge portion at the end of the inflow port in the arrangement direction has a beveled shape.

12. The liquid ejecting apparatus in accordance with claim 7, the liquid ejecting head further comprising:

the substrate in which the common liquid chamber is formed; and a second member in which is formed a second common liquid chamber that holds the liquid to be supplied to the common liquid chamber, wherein an inflow opening that forms the inflow port in the common liquid chamber and enables the common liquid chamber and the second common liquid chamber to communicate is formed in the substrate;

the second common liquid chamber includes a second slanted surface that opposes the inflow opening at an end in the arrangement direction and is slanted so as to approach the inflow opening as the second common liquid chamber progresses toward the end in the arrangement direction; and when, at an area where the inflow opening and the second common liquid chamber connect, the location of an edge portion, of the inflow opening, that is furthest at an end in the arrangement direction is indicated by P1 and the location of an edge portion of the second common liquid chamber is indicated by P2, the position P2 is in the same position as the position P1 in the arrangement direction or is in a position closer to the center in the arrangement direction than the position P1.

* * * * *